United States Patent [19]

Kennedy

[11] Patent Number: 4,463,989

[45] Date of Patent: Aug. 7, 1984

[54] DEVICE FOR CUTTING A RECEPTACLE IN PAVEMENT TO RECEIVE PLOWABLE REFLECTORS

[76] Inventor: Ralph Kennedy, 27 W. Jenkins Ave., Columbus, Ohio 43207

[21] Appl. No.: 328,288

[22] Filed: Dec. 7, 1981

[51] Int. Cl.[3] ..... E01C 23/09

[52] U.S. Cl. ..... 299/39; 299/81; 37/DIG. 19

[58] Field of Search ..... 299/39, 36, 81, 40, 299/41; 404/90, 74, 101, 104, 108; 37/DIG. 19; 404/72; 384/203, 206

[56] References Cited

U.S. PATENT DOCUMENTS

| | | | |
|---|---|---|---|
| 1,782,992 | 11/1930 | Johnson | 404/104 X |
| 1,987,398 | 1/1935 | Gardiner | 404/101 |
| 3,547,492 | 12/1970 | Binger | 299/39 |
| 3,711,158 | 1/1973 | Butcher | 299/39 X |
| 3,771,831 | 11/1973 | Hatcher et al. | 299/39 |
| 3,848,929 | 11/1974 | Miller | 299/39 |
| 3,901,553 | 8/1975 | Binger et al. | 299/39 |
| 4,154,456 | 5/1979 | Jensen et al. | 384/203 X |
| 4,161,055 | 7/1979 | Weremijenko | 384/203 X |
| 4,174,184 | 11/1979 | Heenan | 404/72 |
| 4,262,966 | 4/1981 | Bouplon | 299/39 |
| 4,333,687 | 6/1982 | Barnstorf | 299/81 |

*Primary Examiner*—Ernest R. Purser
*Assistant Examiner*—Beverly E. Hjorth
*Attorney, Agent, or Firm*—John L. Gray

[57] ABSTRACT

A device for cutting a receptacle in pavement to receive a reflector designed to reflect automobile lights, which reflector is contained in a housing so that it is protected from a snowplow mold board during normal plowing operations. Such reflectors are becoming standard in separating traffic lanes and are embedded in the pavement in epoxy. The device simultaneously cuts a receptacle of a shape such that the reflector and its protective cast iron housing may be readily inserted in the pavement. The device enables the receptacle to be cut at right angles to a tangent to the curved portion of the crown of the road, permits rapid exact positioning of the receptacle location and enables the receptacle to be formed in approximately five seconds.

8 Claims, 6 Drawing Figures

DEVICE FOR CUTTING A RECEPTACLE IN PAVEMENT TO RECEIVE PLOWABLE REFLECTORS

BACKGROUND OF THE INVENTION

An increasing number of roadways are being provided with reflective markers imbedded in the roadways to designate the separation between traffic lanes. It is normal practice to provide an intermittent white paint line between traffic lanes, each paint line being ten feet long, separated from the next section of paint line by a distance of 30 feet. This unpainted portion is known as the "skip line." The reflector is positioned exactly in the middle of the skip line 15 feet from the ends of each ten foot paint line. On main highways and straightaways, the reflector is positioned in alternate skip lines. On curves and on rural roads the reflector is positioned on each skip line.

In those portions of the United States that are subject to snowfall and consequent plowing by snowplows to remove the snow, it is necessary to protect the reflector from damage by the edge of the mold board of the snowplow. A standard shape of reflector unit comprising a raised cast iron H-shaped unit in which the reflector is embedded has been developed for this purpose. An example of such a unit is the Stinsonite 96. The slightly raised portion of the cast iron section protruding above the surface of the roadway permits the bottom edge of the snowplow mold board to be guided over the reflector so that it does not come in contact with the reflector and thus the reflector is protected. However, the reflector is high enough to be seen by an automobile driver and reflect light back to the driver from the automobile's headlights. In order to cut a receptacle in the pavement to receive such a protected reflector unit, it has been the practice to attempt to modify a conventional concrete saw by adding to the saw blade a plurality of blades and utilizing the power in the conventional concrete saw to remove a section of the road surface so as to provide a receptacle to receive the reflector assembly. This modification of the conventional concrete saw has resulted in an underpowered, inefficient unit that is hard to control, unsafe to use by the operator because of the passing traffic, difficult to position, and generally results in a very inefficient and expensive operation.

SUMMARY OF THE INVENTION

This invention relates to a portable machine which is self-propelled, contains its own source of cooling and cutting fluid, and which may be used to remove the pavement surface to provide a receptacle to receive a reflector assembly.

The invention may be readily and conveniently located midway between the alternate white stripes segregating traffic lanes in the skip line, automatically permits entry of the cutting portion of the invention at right angles to a tangent to the road surface so that the resulting receptacle will properly position the reflector to conform to the surface characteristics of the road, may readily be moved to a new cutting position, and provides a safe, efficient environment in which the operator can perform the work. Utilizing this invention, an operator can remove sufficient road surface to provide a receptacle for the reflector assembly in approximately five seconds rather than the 30 seconds or more that would be required in the case of a modified cement saw and moreover by use of this invention the receptacle will properly be positioned in the road surface at an angle to the road surface so as to permit correct positioning of the reflector.

An object of this invention therefore is to provide a machine which will quickly and efficiently remove the upper surface of the paving material from a road surface to provide a receptacle adapted to receive a plowable reflector.

Another object of this invention is to provide such a machine in which the cutting portion thereof will always enter the surface of the road at right angles to a tangent which itself is at right angles to the direction of the road.

Another object of this invention is to provide a self-contained unit which will have adequate cutting and cooling fluid so that the unit may be operated continuously for many miles of installation before it is necessary to replenish the cutting and cooling fluid.

It is a further object of this invention to provide a unit that may be rapidly and easily moved from one cutting position to its next cutting position.

It is still another object of this invention to provide such a machine which may quickly and easily be positioned at the correct location for the cutting operation.

It is a still further object of this invention to provide a self-contained machine which may be readily moved from one location to another at normal highway speeds.

These together with other objects and advantages of the invention will become apparent in the details of construction and operation as more fully described hereinafter and claimed, reference being had to the accompanying drawings forming a part hereof, wherein like numerals refer to like parts throughout.

DETAILED DESCRIPTION OF THE INVENTION

Figure 1:
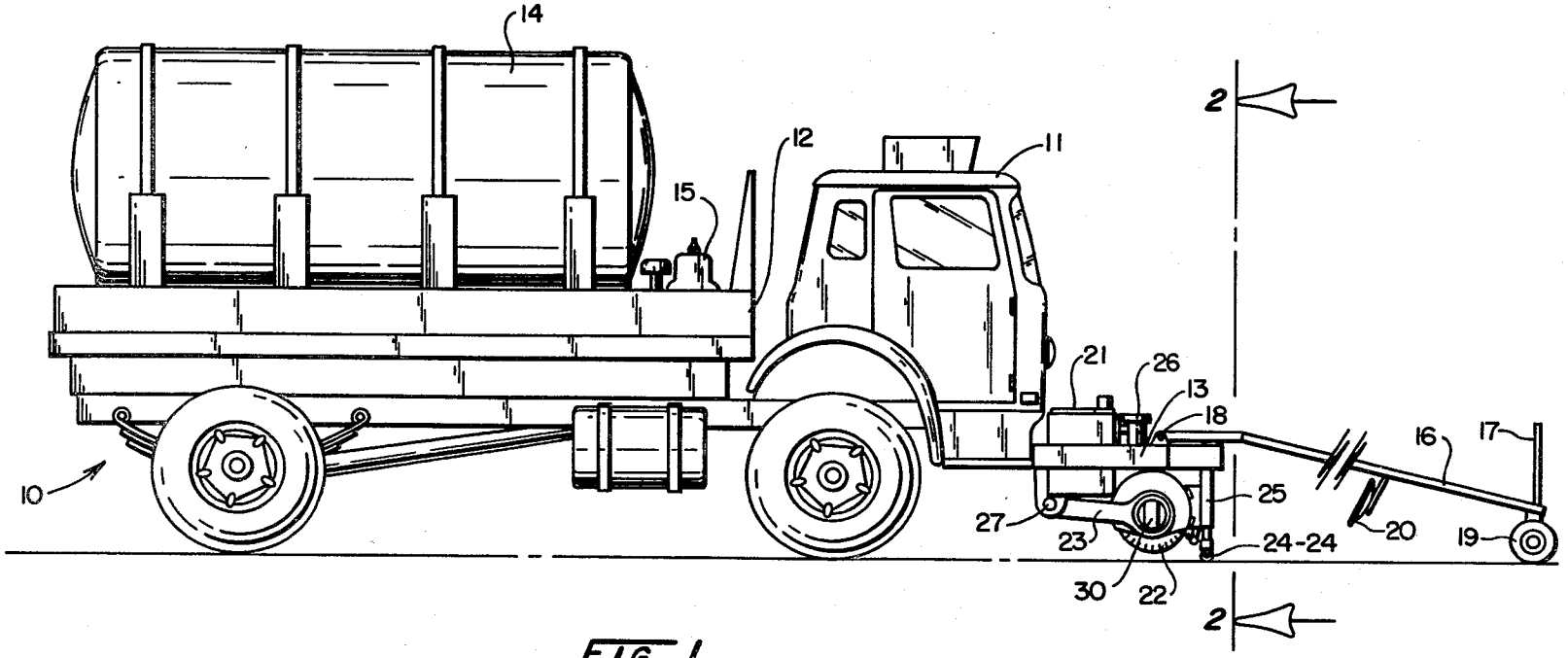
FIG. 1 is a side elevation view of the pavement cutting device with the cutting portion disengaged from the roadway surface and with a protective shroud removed.

Referring now more particularly to FIG. 1, applicant's invention is shown mounted on the forward end of a conventional truck body indicated generally at 10. The truck is provided with a conventional cab 11 and a flat body 12. The forward bumper of the truck has been removed and has been replaced with a stronger supporting framework 13. The truck has a 2,000 gallon water tank 14 mounted on flatbed portion 12. The water contained in this tank 14 is used as a cutting fluid and also for cooling purposes. It is continuously recirculated to the cutting motor by means of the pump 15 which may either be separately powered by a gasoline engine or which may be operated by means of hydraulic fluid from the main hydraulic pump. A guide pole 16 having a vertical sight bar 17 positioned thereon is attached to the frame 13 by hinged connection 18 and is supported by wheel 19. A mirror 20 is positioned on the guide pole 16 to enable the operator located in the cab 11 to view the cutting action.

Since each reflector is positioned midway in the skip line and the length of the ship line is 30 feet, the distance from the center of the wheel 19 to the cutting tool is 15 feet, thus when the wheel is placed at the end of a white painted ten-foot section, cutting action takes place directly in the middle of the skip line. The hydraulic reservoir 21 houses the hydraulic fluid to operate the motor which operates the cutting tool 22 which is mounted on arm 23. Hydraulic cylinder 26 is shown which is used to raise and lower cutting tool 22. Arm 23 which supports the cutting tool 22 is pivotally attached to frame 13 at pivot point 27.

Figure 2:
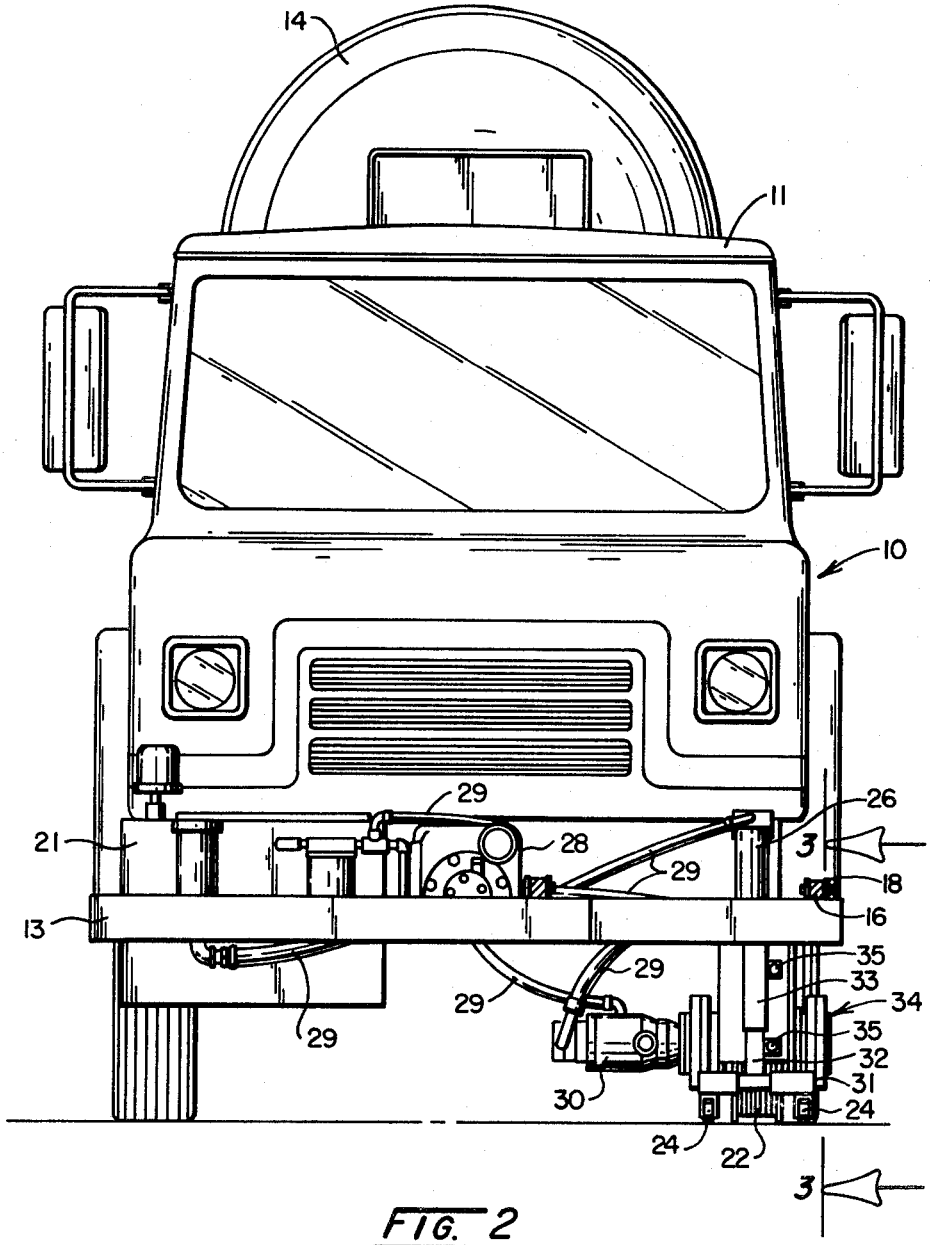
FIG. 2 is a section of FIG. 1 on the section line 2—2 of FIG. 1.

Referring now more particularly to FIG. 2, the hydraulic pump 28 is driven by the crankshaft of the truck engine through suitable gearing and is connected by appropriate hydraulic hoses 29—29 to the hydraulic motor 30 which rotates the cutting tool 22. The pump 28 is also connected to the hydraulic cylinder 26 which is utilized to raise and lower the cutting tool 22.

The oil in the hyraulic reservoir 21 is continuously cooled by the water contained in the tank 14 and circulated to cooling coils in the reservoir 21 by means of the pump 15. A satisfactory pump to use for this purpose is one manufactured by Sunstrand. Hydraulic fluid passes through hoses 29—29 to a manifold which is shown as part of the pump and then the hydraulic fluid goes directly to the motor 30 to avoid direct thrust on the motor 30. The pump 28 is provided with a case drain that provides lubrication to the motor 30. While the pump 28 and the motor 30 consist essentially of a closed circuit, twenty percent of the hydraulic fluid is bypassed around the pump 28 and back to the reservoir 21 for cooling purposes. Appropriate filters (not shown) are provided.

All of the controls to operate the device are located inside the cab and are not shown. The motor 30 is capable of exerting a horsepower of from 70 to 120 hp., depending upon the pressure of the oil going to it from the pump 28. In order to reverse the motor 30 or to modify its speed, the flow from the pump 28 is reversed or the speed of pumping is altered.

The wheels 24—24 are mounted on a crosspiece 31 which is rigidly connected to a vertical member 32 which is spring-loaded and positioned inside shaft 33. Shaft 33 is rigidly attached to the cutting and motor assembly shown generally at 34 by means of bolts 35—35. The entire cutting assembly 34 is enclosed in a shroud which prevents any pavement particles from being discharged and accidentally injuring anyone, which shroud has been removed for purposes of clarity in illustrating the cutting assembly 34.

Figure 3:
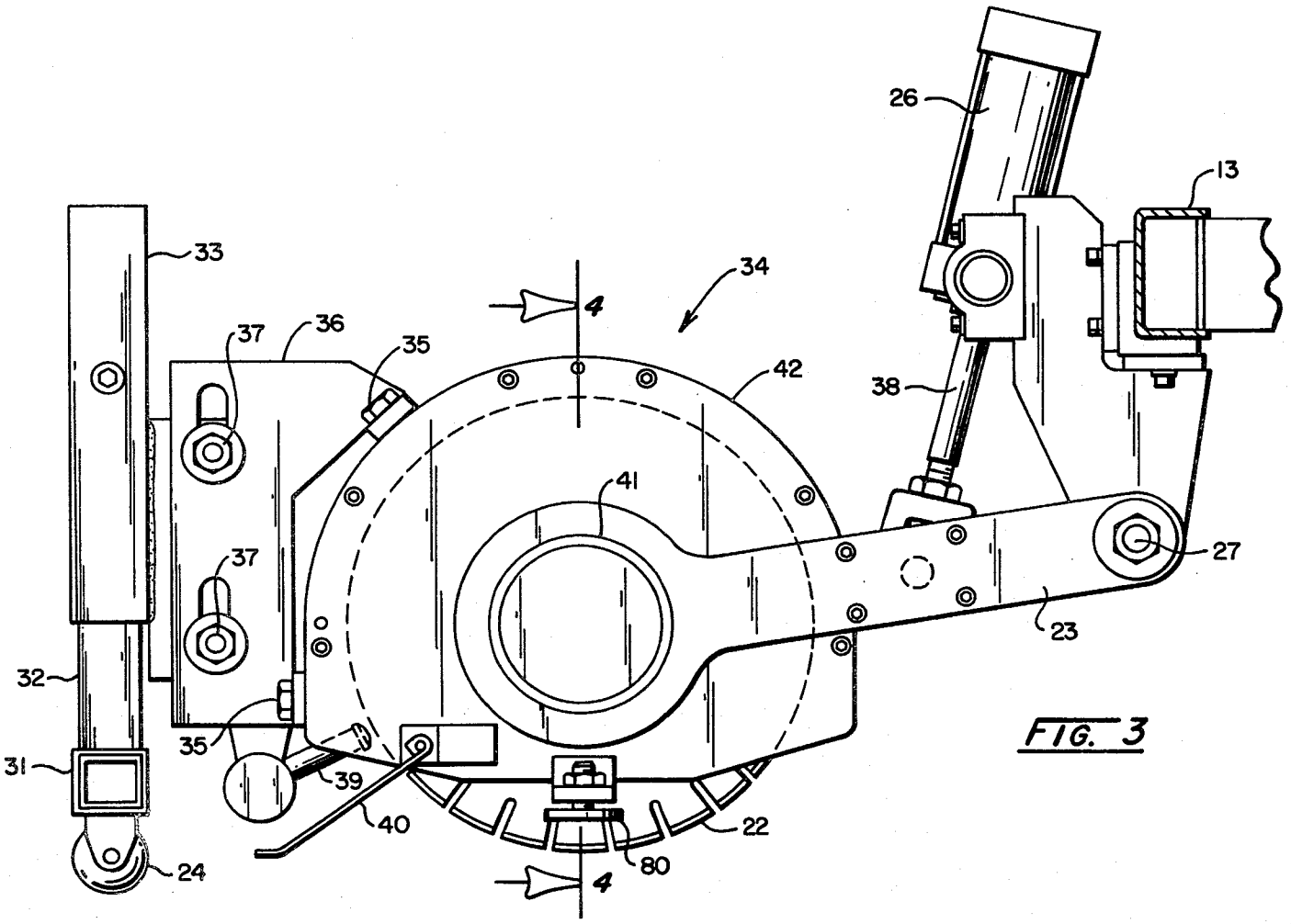
FIG. 3 is a section of FIG. 2 on the section line 3—3 of FIG. 2 showing the cutting portion of applicant's invention in enlarged detail.

Referring now more particularly to FIG. 3, it will be seen that tube 33 is fixedly connected to the cutting assembly 34 by means of flange 36 and its vertical position may be modified by means of adjustable bolts 37—37. Hydraulic cylinder 26 is provided with a shaft 38 which is connected to arm 23 to permit raising and lowering of the cutting assembly 34. Water jet 39 is positioned to spray water directly on the cutting discs 22—22 and is turned on and off by feeler 40 through suitable switching. Cutting members 22—22 are positioned on a shaft which is journaled in journal housing 41 at one end and connected to hydraulic motor 30 at its opposite end. The housing 42 surrounds a majority of the portion of the cutting discs 22—22.

Figure 4:
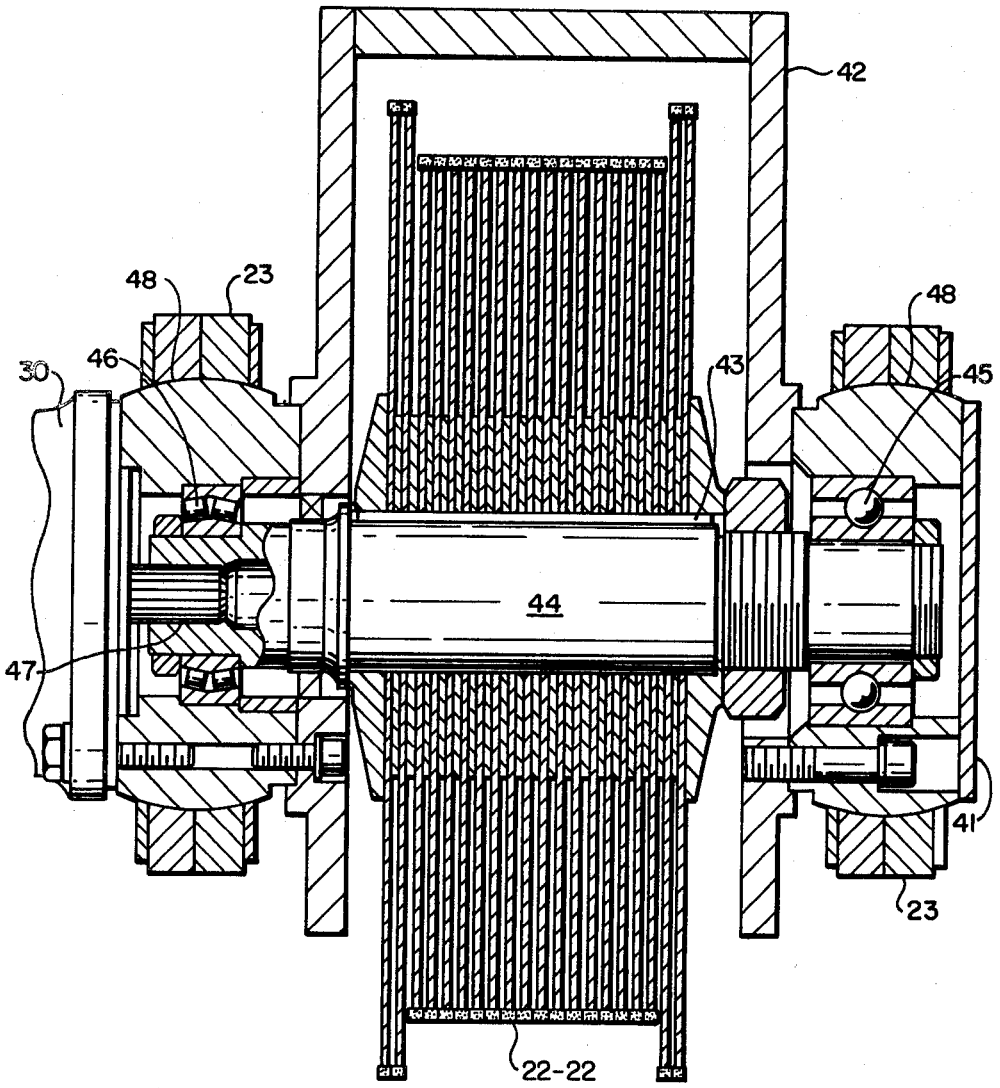
FIG. 4 is a section of FIG. 3 on the section line 4—4 of FIG. 3 showing the interior of the cutting portion of the invention in further enlarged detail.

Referring now more particularly to FIG. 4, the cutting discs 22—22 are keyed through suitable key 43 to shaft 44 which is in turn positioned in bearings 45 and 46. The entire assembly and driven portion 47 of shaft 44 is connected directly to the hydraulic motor 30. The entire assembly is mounted in spherical bearings 48—48 which permits an approximate tilting of 12° on either side of the vertical depending upon the curvature of the road as determined by the wheels 24—24. The blades 22—22 are all diamond tipped cutting blades and there is a total of sixteen 18 inch diameter blades located in the center of the cutting head assembly and on each end there are two 20 inch diameter blades, each blade is one-quarter inch wide, so as shown, each blade section is actually one-half inch wide, there being two blades per unit. The total width is approximately six inches.

Figure 5:
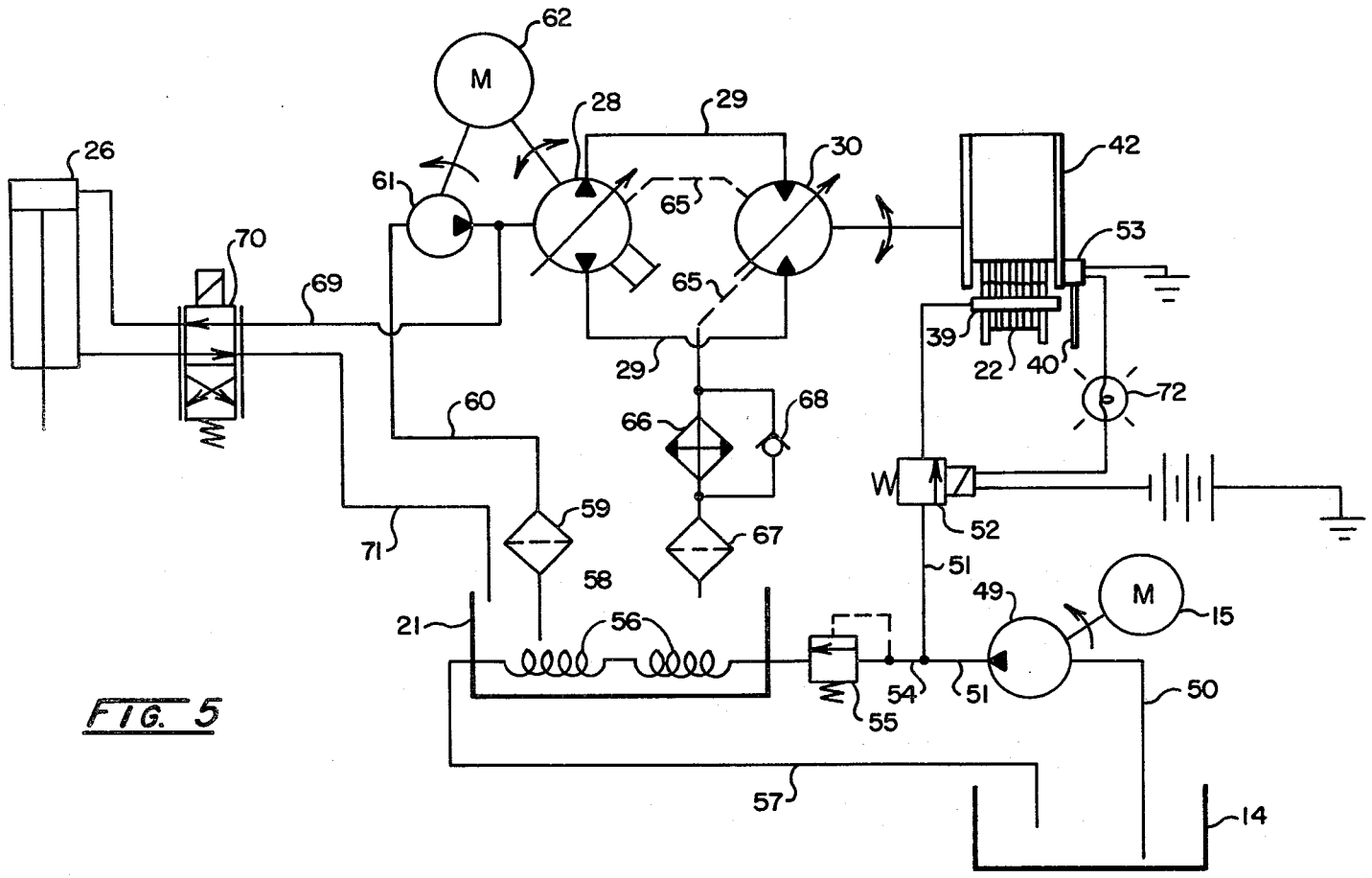
FIG. 5 is a hydraulic and electrical schematic of the control system used to operate the cutting portion of applicant's invention.

Referring now more particularly to FIG. 5, set forth therein is a schematic of the hydraulic and electrical control system for the device. The pump motor 15 is shown operatively connected to a water pump 49 which has its suction pipe 50 connected to the water tank 14. The pump 49, which is a fixed displacement unidirectional water pump, directs water through pipes 51—51 and through a solenoid valve 52 which is normally closed to water nozzle 39 so that the water can be sprayed on the cutting wheels 22—22. The solenoid valve 52 is actuated by the feeler 40 which actuates switch 53. The water also flows through pipe 54 and through pressure control valve 55, through cooling coils 56—56, and hydraulic reservoir 21 and thence returns through conduit 57 to the water tank 14. The purpose of the pressure control valve 55 is to close if the pressure drops below the normally required 80 psi at water jet 39.

Hydraulic fluid is removed from the hydraulic reservoir 21 via suction line 58 through filter 59 and line 60 to primer pump 61 which is driven from the truck motor 62. The truck motor 62 also drives the variable displacement hyraulic pump 28 which is noncompensated, bi-directional, and manually controlled. Pump 28 transmits hydraulic fluid through lines 29—29, depending upon direction of rotation desired, to hydraulic motor 30. Case drains 65—65 are also shown which permit some of the hydraulic fluid to drain back through cooler 66 and filter 67 to the hydraulic reservoir 21. 68 is a check valve.

Primer pump 61 in addition to priming pump 28, also via line 69, pumps hydraulic fluid through solenoid controlled infinite position four-way valve 70 to hydraulic cylinder 26 which is used to raise and lower the cutting head 34, and the discharge from cylinder 26 is returned to the hydraulic reservoir 21 via line 71. Light 72 is an indication to the operator when water is flowing out of water jet 39 onto cutting wheels 22—22.

Figure 6:
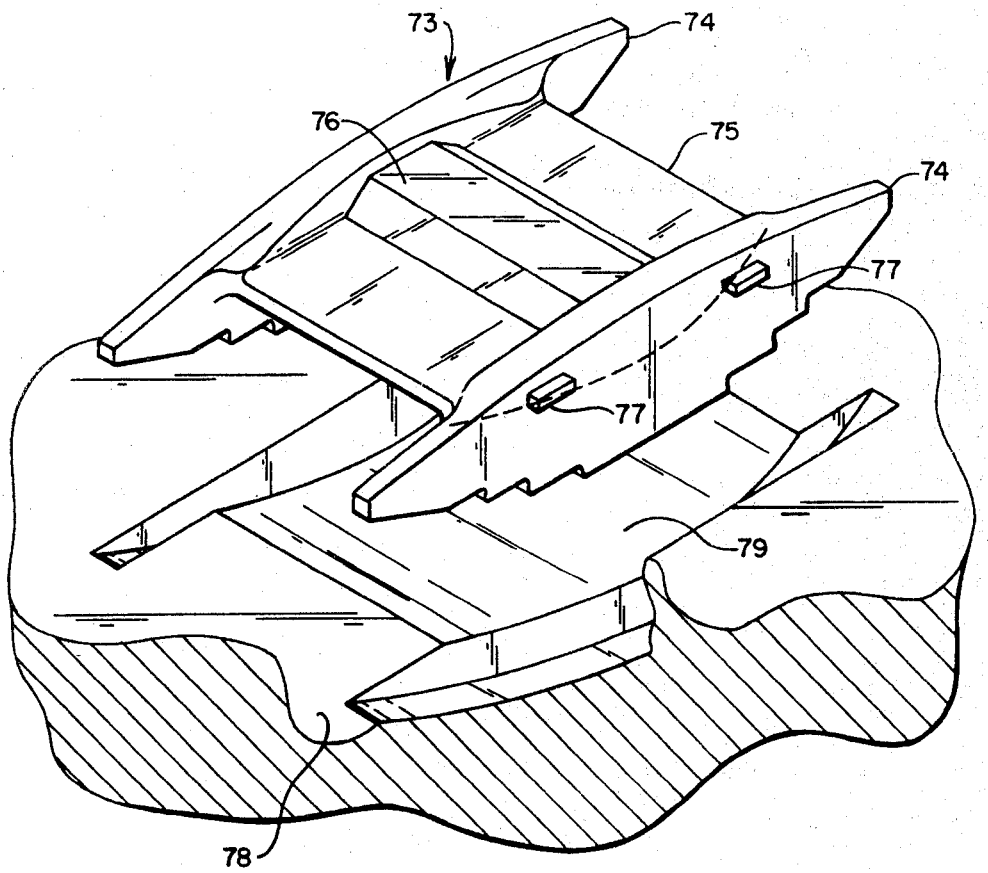
FIG. 6 is an exploded perspective view of the plowable type road reflector and a section of pavement with a receptacle cut therein as provided by applicant's invention which is adapted to receive the plowable reflector.

Referring now more particularly to FIG. 6, the reflector assembly is shown generally at 73, and comprises two protective portions 74—74 and a central support portion 75 to support the reflector 76. Tabs 77—77 rest on the edge of the pavement which has not been excavated. The pavement 78 is shown with a receptacle area 79, which has been removed by the invention, adapted to receive the reflector assembly 73 which may be epoxied in place.

In operation, the device is driven to the particular section of highway in which the reflector assemblies 73—73 are to be installed and the guide pole 16 is lowered into place from its vertical highway transport position. The wheel 19 is positioned at the end of the white mark which is closer to the driver and this positions the cutting wheel 22 midway in the skip line. During transportation from one work place to another, the blades are normally carried about eight inches above the surface of the road. During the cutting operation and going from cutting position to cutting position, the blades are normally carried about four inches above the surface of the road. When the blades are about eight inches above the surface of the road, the wheels 24—24 are retracted from the surface of the road so that the main wheels of the truck are the only portion of the device in contact with the road surface. The actual depth of cut is about one and a half inches and since the cutting motor 30 and the cutting assembly 34 are pivoted on arm 23 about two feet from the pivot point 27, this circular movement has no significant effect on the shape of the cut because of the short distance that the cutting wheels move.

Referring more particularly to FIG. 3, a mechanical stop 80 is provided to limit the total depth of cut. This distance may be adjusted.

The operator in the cab 11 can change the direction of the motor 30 and also the speed of the motor 30, which can go from zero to 2,200 rpm. In order to stop the motor 30, the pump 28 is put in neutral since it is directly connected to the crankshaft of the truck motor 62. The motor 30 is reversible and, generally speaking, the motor 30 is reversed about every 5,000 cuts because the diamond cutting blades tend to glaze over after awhile and while reversal results in sacrificing some of the diamonds, it is necessary in order to get longer life from a given cutting wheel.

The operator will have aligned the cutting wheels 22—22 with the pointer 17 and positioned it with wheel 19 and then can commence rotation of the cutting member 22. Following this, the operator then lowers the entire assembly down to the pavement. The feeler 40 causes the water to flow through water jet 39 and the cutting wheels 22—22 enter the pavement until they are stopped by stop 80 at which point the tool is lifted from the pavement and the water is automatically shut off. The high pressure water (80 psi) keeps the cutting wheels 22—22 clean and also blasts particles of pavement from the receptacle area 79. The wheels 24—24 ensure that the cut is made at right angles to a tangent to the crown of the road thus ensuring that the reflector assembly 73 will be properly located with respect to the road surface. The operator then moves the vehicle forward to the next location. Water from tank 14 is continuously flowing through coils 56—56 so as to continuously cool the hydraulic fluid in hydraulic reservoir 21.

Thus it will be seen that the subject invention provides a rapid, efficient, safe, reliable method of providing a receptacle in the surface of the road designed to receive the reflector assembly 73.

While this invention has been described in its preferred embodiment, it is appreciated that variations thereon may be made without departing from the proper scope and spirit of the invention.

What is claimed is:

1. A device for cutting a receptacle in the surface of pavement, said receptacle being adapted to receive a plowable headlight reflector, comprising support means positioned on said pavement, means associated with said support means for moving said support means from place to place, a container on said support means adapted to house cutting and cooling fluid, a rotary cutting means depending from said support means and of a width adapted to cut a receptacle in the surface of said pavement of a size adapted to receive a plowable headlight reflector and supported on an axis capable of being tilted, a hydraulic pump, a hydraulic motor operated by said hydraulic pump and operatively connected to said cutting means, means for raising and lowering said rotary cutting means into engagement with the surface of said pavement on which said support means is positioned, and means, engaging the surface of said pavement, for automatically tilting the axis of rotation of said rotary cutting means so that said rotary cutting means performs its cutting function while at right angles to the tangent to that portion of the surface in which said receptacle is to be cut.

2. The device of claim 1 wherein said means for raising and lowering said rotary cutting means into engagement with the surface on which said support means is positioned is a hydraulic cylinder which is supplied with hydraulic fluid by said pump.

3. The device of claim 1 wherein said hydraulic fluid in said hydraulic pump is continuously cooled by the cooling fluid in said container.

4. The device of claim 1 wherein said cooling and cutting fluid in said container is sprayed on said rotary cutting means while it is performing its cutting function.

5. The device of claim 1 wherein said means for positioning said rotary cutting means so that said rotary cutting means performs its cutting function while at right angles to the surface on which said support means is positioned comprises two wheels positioned on an axle parallel to the axis of said rotary cutting means, and spaced therefrom.

6. The device of claim 5 wherein said rotary cutting means is positioned on a shaft provided at each end with a spherical bearing.

7. The device of claim 1 wherein means is included for automatically spraying said cooling and cutting fluid in said container on said rotary cutting means when said cutting means has reached a selected position with respect to the surface on which said support means is positioned.

8. The device of claim 1 wherein means is included for automatically determining the depth of cut of said rotary cutting means.

* * * * *